United States Patent [19]

Goyal

[11] 3,948,446

[45] Apr. 6, 1976

[54] FUEL INJECTION NOZZLE

[75] Inventor: Madangopal Rameshwar Goyal, Cedar Falls, Iowa

[73] Assignee: Deere & Company, Moline, Ill.

[22] Filed: Jan. 29, 1975

[21] Appl. No.: 545,137

[52] U.S. Cl. ..... 239/120; 239/533

[51] Int. Cl.[2] ..... B05B 1/28; B05B 1/30

[58] Field of Search ..... 239/88–91, 239/96, 120, 533, 570

[56] References Cited

UNITED STATES PATENTS

| | | | |
|---|---|---|---|
| 1,977,005 | 10/1934 | Mock | 239/533 X |
| 2,536,542 | 1/1951 | Evans et al. | 239/120 X |
| 3,403,861 | 10/1968 | Eidtmann et al. | 239/533 |
| 3,777,986 | 12/1973 | Kinzel et al. | 239/533 |

FOREIGN PATENTS OR APPLICATIONS

| | | | |
|---|---|---|---|
| 527,418 | 10/1940 | United Kingdom | 239/533 |
| 544,384 | 4/1942 | United Kingdom | 239/120 |

*Primary Examiner*—Robert S. Ward, Jr.

[57] ABSTRACT

A fuel injection nozzle of the type having a reciprocating needle valve normally biased to a closed position by a spring and biased to an open position by pressurized fuel in which a leak-off passage leads from the spring chamber to a fuel inlet passage and a check valve in the leak-off passage prevents fuel flow from the inlet passage to the spring chamber.

5 Claims, 1 Drawing Figure

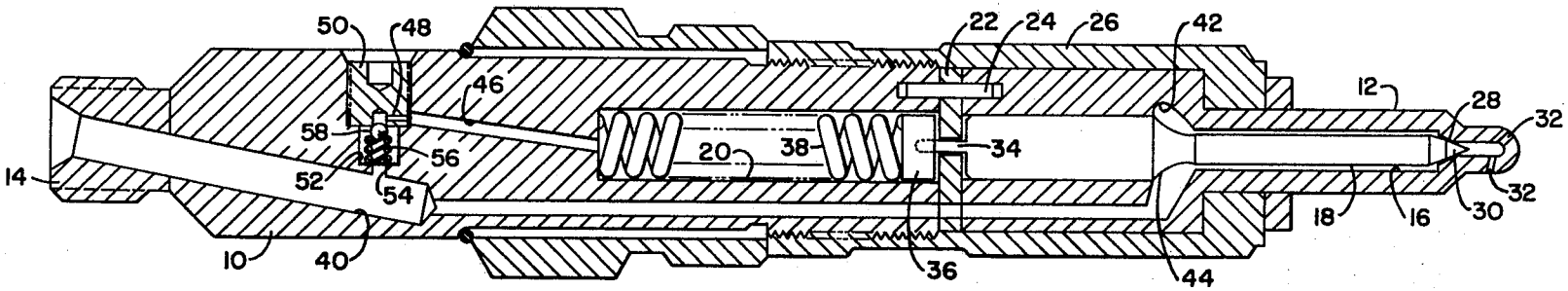
32
32
28
30
16
12
18
42
44
26
24
34
22
36
38
20
46
56
48
54
50
58
52
40
10
14

FUEL INJECTION NOZZLE

BACKGROUND OF THE INVENTION

The present invention relates to fuel injection nozzles and more particularly relates to a fuel injection nozzle with a novel leak-off system.

One of the most common types of fuel injection nozzles employs a reciprocating needle which is spring-biased to its closed position and opened by fuel pressure. The major disadvantage with this type of fuel injection nozzle is that the fuel at the high pressure end of the valve will leak past the valve stem to a low pressure spring chamber. Unless some provision is made for draining the spring chamber, a hydraulic block could result. In order to prevent a hydraulic block, it has been common practice to employ a fuel leak-off conduit attached to the nozzle to return leakage fuel back to the reservoir or the intake of the pump. The drawbacks of this arrangement is that it complicates the installation and removal procedures by adding an additional conduit for each nozzle.

Many attempts have been made to obviate the need for leakoff conduits. One attempt has been to provide a draining passage for the leakage fuel directly to the intake manifold of the engine. This arrangement can result in an increased emission of smoke and hydrocarbons from the engine and can cause carbon deposits on the inlet valve.

In another attempt to eliminate the leak-off conduits, the fuel injection nozzle was provided with a large chamber for leakage fuel and reverse leakage during period of low pressure was relied upon to prevent hydraulic lock. This arrangement had the disadvantage of requiring a larger nozzle and the pressure in the chamber would build up to the point where it would effect opening of the valve.

SUMMARY OF THE INVENTION

It is a primary object of the present invention to provide a fuel injection nozzle that overcomes the above-mentioned problems of the prior art.

Another object of the present invention is to provide a fuel injection nozzle which has an internal drain for leakage fuel.

A more specific object of the present invention is to provide a fuel injection nozzle in which the spring chamber is vented to the fuel inlet passage of the nozzle through a one-way valve.

The above and additional objects and advantages of the present invention will become apparent to those skilled in the art from a reading of the following description when read in conjunction with accompanying drawing.

BRIEF DESCRIPTION OF THE DRAWING

The single FIGURE is a sectional view of a preferred embodiment of the invention.

DESCRIPTION OF THE PREFERRED EMBODIMENT

Referring to the drawing, a nozzle body 10 has an injection end 12 and an inlet end 14, the former having a needle valve bore 16 in which is disposed a needle valve 18 of conventional structure. A spring chamber 20 is formed in the nozzle body and is separated from the valve bore 16 by a spacer 22. The injection end of the nozzle body and the spacer 22 are held in proper relation to the main portion of the nozzle body by positioning pin 24 and a retaining sleeve 26. As is conventional, the nose end of the valve bore 16 is provided with a seat area 28 for a tapered end 30 of the needle valve 18 so that, upon reciprocal movement of the needle valve 18, the seat 28 and tapered end 30 cooperate to alternately establish and block communication between the valve bore 16 and nozzle outlets 32.

A projection 34 on the inner end of the needle valve 18 extends through an aperture in the spacer 22 and into the spring chamber 20 where it is received by a spring abutment member 36. A compression spring 38 acts between one end of a spring chamber 20 and a spring abutment member 36 to normally bias the needle valve 18 to its closed position. An inlet passage 40 extends through the valve body to a chamber 42 which is formed by an enlarged area of the valve bore 16 so that high pressure fuel can act on a differential area 44 of the needle valve to move the needle valve in opposition to the bias of the spring 38.

A fluid passage extends between the spring chamber 20 and the inlet passage 40 and is formed by a first passage 46 extending from the spring chamber 20 to a second passage 48 extending through a plug member 50 and communicating with a valve chamber 52 which in turn is in communication with the inlet passage 40 via a third passage 54. A spring 56 in the valve chamber 52 normally holds a ball 58 against a seat formed by the plug 50 at the juncture between the passage 48 and the chamber 52. The spring 56 and ball 58 form a spring loaded one-way check valve which prevents the flow of fluid from the inlet passage 40 to a spring chamber 20.

In operation, fuel from a suitable pump (not shown) is directed through the inlet passage 40 to the chamber 42 where it acts on the differential area 44 of the needle valve 18. When the fluid pressure reaches a predetermined level, the valve 18 moves inwardly so that the tapered end 30 moves away from its seat 28. The fuel then passes through the valve bore 16 between the tapered end 30 and seat 28 and out the nozzle outlets 32 to a combustion chamber of an engine with which the nozzle will be associated. Inward movement of the needle valve 18 is limited by engagement between the valve and spacer 22. As the needle valve moves inwardly, leakage of fuel occurs between the inner end of the needle valve and the valve bore into the spring chamber 38. When the injection cycle is terminated, the fuel pressure in the chamber 42 and inlet passage 40 decreases to an extremely low value. After a number of repeated cycles, the leakage fuel will begin to build up pressure in the spring chamber 20. However, between injection cycles, when the pressure in the inlet passage 40 is at a low value, the ball 48 will unseat and permit the passage of fuel from the spring chamber 20 to the inlet passage 40. The spring 56 maintains a pressure level in the spring chamber 20 that aids in providing a fast closing of the needle valve at the end of the injection cycle, thus reducing the objectionable black smoke commonly encountered with diesel engines. It has been found that by making the volume of the spring chamber 20 one hundred and fifty times greater or more than the displacement of the needle valve 34 the pressure in the spring chamber 20 has no detrimental affect on the opening operation of the needle valve.

Having thus described the preferred embodiment of the invention, various modifications within the spirit and scope of the invention will become apparent to those skilled in the art and can be made without departing from the underlying principles of the invention. Therefore, the invention should not be limited by specific illustration and description, but only by the following claims.

I claim:

1. A fuel injection nozzle of the type in which an axially reciprocatable needle valve is biased in one direction by spring means contained in a spring chamber and in the opposite direction by fluid pressure routed to the valve by fluid inlet passage means, characterized in that fluid passage means provides direct communication between the spring chamber and inlet passage means, and a single one-way valve means in the fluid line passage means prevents fluid flow from the inlet passage means to the spring chamber while permitting fluid flow from the spring chamber to the inlet passage means.

2. A fuel injection nozzle as set forth in claim 1 wherein the volume of the spring chamber is at least approximately one hundred and fifty times greater than the displacement of the needle valve.

3. A fuel injection nozzle as set forth in claim 1 wherein said single one-way valve means is a spring loaded check valve.

4. A fuel injection nozzle as set forth in claim 1 wherein said single one-way valve means is a spring loaded ball check valve.

5. A fuel injection nozzle as set forth in claim 1 wherein the volume of the spring chamber is approximately one hundred and fifty times greater, or more, than the displacement of the needle valve, and the single one-way valve means is a spring loaded check valve.

* * * * *